US005860043A

United States Patent [19]

Ahn

[11] Patent Number: 5,860,043

[45] Date of Patent: Jan. 12, 1999

[54] ELECTROPHOTOGRAPHIC APPARATUS HAVING A DEVELOPMENT UNIT SHIFTER

[75] Inventor: Byeong-Hwa Ahn, Suwon, Rep. of Korea

[73] Assignee: SamSung Electronics Co., Ltd., Suwon, Rep. of Korea

[21] Appl. No.: 924,247

[22] Filed: Sep. 5, 1997

[30] Foreign Application Priority Data

Sep. 5, 1996 [KR] Rep. of Korea ..... 1996 28299

[51] Int. Cl.[6] ..... G03G 21/16

[52] U.S. Cl. ..... 399/111

[58] Field of Search ..... 399/111, 119, 399/110, 126, 121, 297, 318

[56] References Cited

U.S. PATENT DOCUMENTS 4,609,276 9/1986 Mitzutani ..... 399/111
4,931,839 6/1990 Tompkins et al. .
5,051,783 9/1991 Sato .
5,089,849 2/1992 Hiraoka ..... 399/119
5,534,984 7/1996 Inoue .
5,596,395 1/1997 Sawamura et al. ..... 399/297 X

*Primary Examiner*—S. Lee
*Attorney, Agent, or Firm*—Robert E. Bushnell, Esq.

[57] ABSTRACT

An electrophotographic apparatus made up of a toner image transfer roller and a developing unit. The developing unit is provided with a developing unit shifter to shift the developing unit upwards or downwards so as to make the photoconductive drum contact or separated from the toner image transfer roller according to whether a sheet of paper is supplied between them or not. The shifter is made up of a pair of rotating cams that cause the developing unit containing the photoconductive drum to make contact with the transfer roller.

10 Claims, 5 Drawing Sheets

ELECTROPHOTOGRAPHIC APPARATUS HAVING A DEVELOPMENT UNIT SHIFTER

This application makes reference to, incorporates the same herein, and claims all benefits accruing under 35 U.S.C. § 119 from an application for Electrophotographic Apparatus earlier filed in the Korean Industrial Property Office on Sep. 5, 1997 and there duly assigned Ser. No. 28299/1996.

FIELD OF THE INVENTION

The present invention concerns an electrophotographic apparatus such as laser beam printer, electronic copier, facsimile machine using ordinary paper, versatile office machine, etc., and more particularly a developing unit with a photoconductive (photosensitive) drum in an electrophotographic apparatus.

DESCRIPTION OF THE RELATED ART

Cams have been used to periodically separate a transfer roller from a photosensitive drum in an electrophotographic process. For example, U.S. Pat. No. 5,051,783 for a Cam for Shifting a Transfer Device and a Cleaning Device to Sato discloses a cam mechanism which is driven to rotate around an axis of a photoreceptor drum, to cause the transfer roller to periodically become separated from the photoreceptor drum. What is needed is a simpler design where a pair of rotating cams cause a developing unit containing a photosensitive drum to periodically come into contact with the transfer roller.

SUMMARY OF THE INVENTION

An object is an improved electrophotographic device where the transfer roller periodically separates from the photosensitive drum.

Another object is to cause the photosensitive drum to separate from a transfer roller by a pair of rotating cams located adjacent to the developing unit containing the photosensitive drum and opposite from where the developing unit and the photosensitive drum makes contact with the transfer roller.

According to the present invention, an electrophotographic apparatus comprises a toner image transfer roller and a developing unit which is provided with a developing unit shifter to shift the developing unit upwards or downwards so as to make the photoconductive drum contact or separated from the toner image transfer roller according as a sheet of paper is supplied between them or not. The developing unit is composed of the photoconductive drum rotated at a given speed, a charging roller for charging the surface of the photoconductive drum to form a uniform electric charge layer and a developing roller for developing a latent image formed on the surface of the photoconductive drum with a toner. A pair of rotating cams are positioned adjacent to the developing unit of a photosensitive drum and on opposite sides of the developing unit from the transfer roller to cause the photosensitive drum to periodically make contact with the transfer roller when a sheet of recording media passes therebetween.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
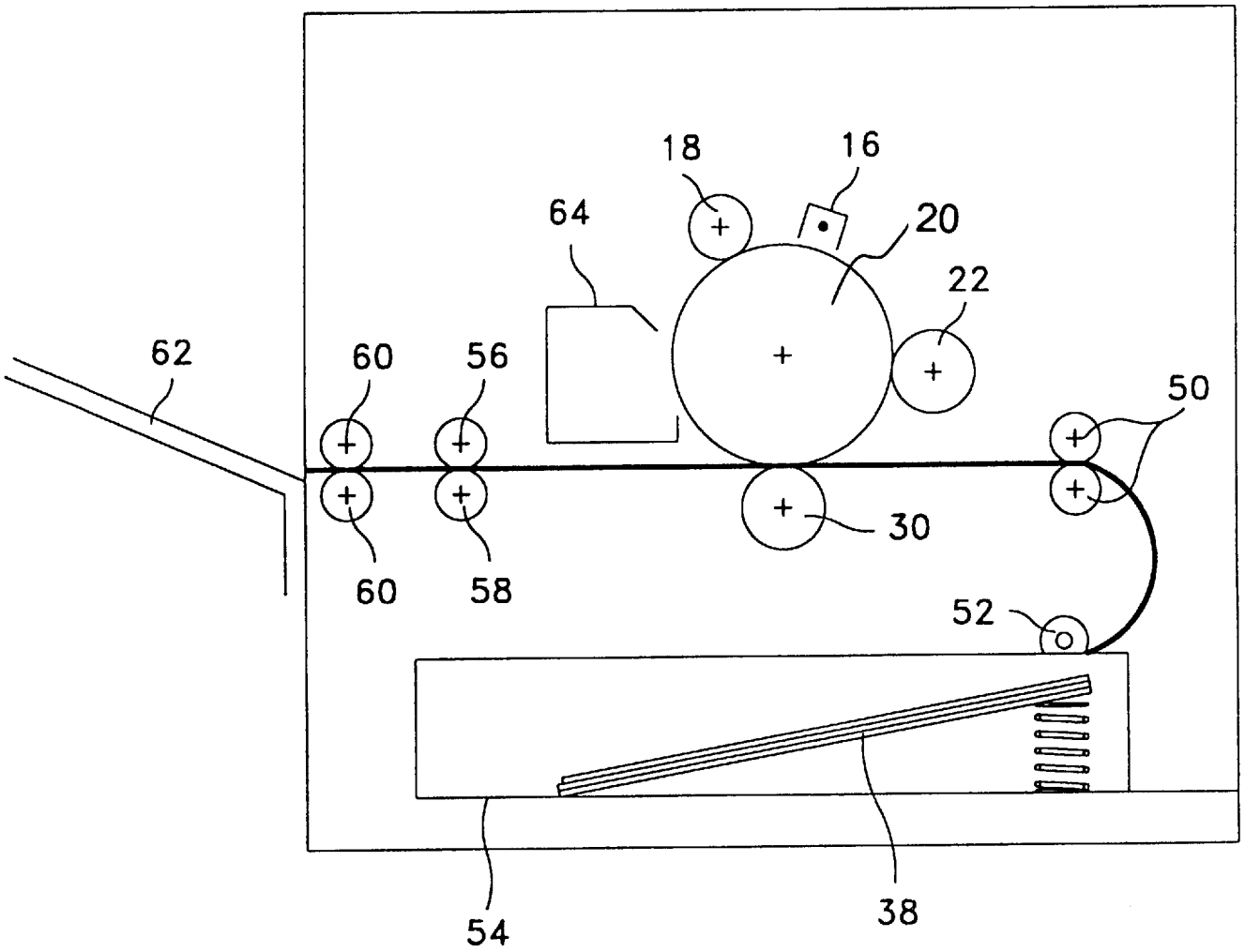
FIG. 1 (CONVENTIONAL ART)
FIG. 1 is a schematic diagram for illustrating the structure of a conventional electrophotographic apparatus.

Referring to FIG. 1, an earlier electrophotographic apparatus comprises a photoconductive drum 20 uniformly charged by means of a corona discharge of a charging roller 18 and an exposing unit 16 for selectively exposing the surface of the photoconductive drum 20 to form an electrostatic latent image according to an image or character signal. The latent image formed on the surface of the photoconductive drum 20 is developed with a toner supplied by a developing roller 22.

Meanwhile, a sheet of paper 38 is picked up by a pickup roller 52 from a paper supplying cassette 54 supplied to a conveyor roller unit 50, which in turn conveys the sheet to the toner image transfer roller 30 to press the sheet 38 against the toner image on the photosensitive drum 20. The sheet 38 impressed with the toner image is passed through between the heating and pressure rolls 56 and 58 of a toner fixing device fixing the image with heat and pressure. Finally the printed sheet 38 is discharged by a discharging roller unit 60 to a collector plate 62. The residual toner particles on the photosensitive drum 20 after passing the image transfer roller are removed by a cleaner 64, and the electrostatic latent image erased by a charge removal lamp.

Figure 2:
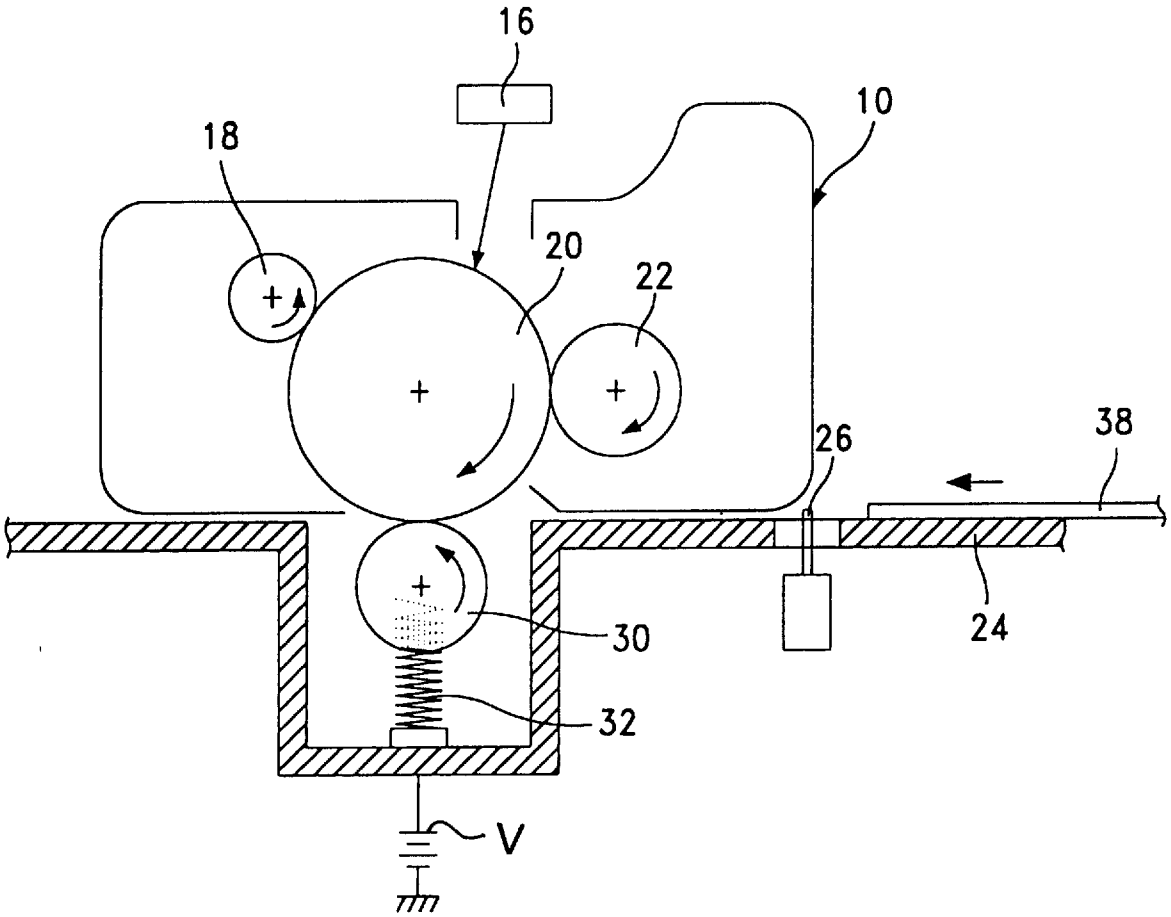
FIG. 2 (CONVENTIONAL ART)
FIG. 2 is a schematic diagram for illustrating the photoconductive drum to always contact the transfer roller in a conventional electrophotographic apparatus.

In such electrophotographic apparatus, the photoconductive drum is designed to contact the image transfer roller at all times regardless of recording paper between them. More specifically describing this with reference to FIG. 2, the conventional developing unit 10 includes the photoconductive drum 20 rotated at a given speed and the charging roller 18 mounted on one side of the surface of the photoconductive drum 20. The developing roller 22 is mounted on another side of the surface of the photoconductive drum 20. The exposing unit 16 is mounted above the photoconductive drum 20 between the charging roller 18 and the developing roller 22. Mounted below the developing unit 10 is the image transfer roller 30 to contact the underside of the photoconductive drum 20 so as to transfer a toner image formed on the photoconductive drum 20 to a sheet of paper 38. A pressure spring 32 is mounted in the main frame 24 to constantly push the underside of the toner image transfer roller 30 against the photoconductive drum 20. One end of the pressure spring 32 is connected with a voltage source V.

In operation, a sheet of paper 38 conveyed by the conveyor unit 50 is detected by a first sensor 26 to make the toner image transfer roller 30 applied with a given voltage, and then entering between the photoconductive drum 20 and the toner image transfer roller 30. A toner image formed on the photoconductive drum 20 is transferred by means of the pressure of the transfer roller 30 to the sheet 38. Thereafter, the sheet 38 is discharged outside while the transfer roller 30 is cut off the given voltage.

In such conventional electrophotographic apparatus, since the toner image transfer roller 30 always contacts the photoconductive drum 20, the background toner remaining on the surface of the photoconductive drum 20 stains the surface of the transfer roller 30 when there is no sheet of paper 38 or a paper jam occurs. This lowers the resistance value between the photoconductive drum 20 and the transfer roller 30 reducing the transfer efficiency of the transfer roller 30, and stains the back surface of the sheet 38.

Figure 3:
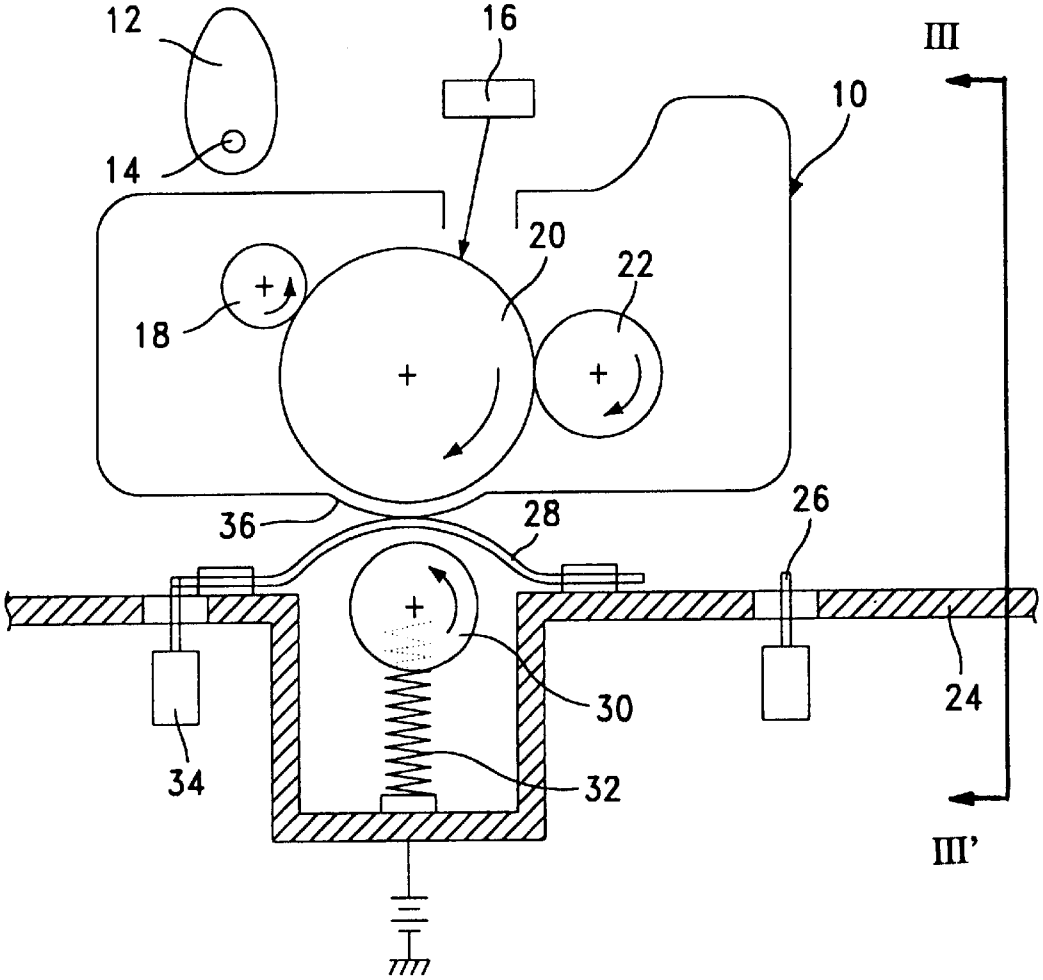
FIG. 3 is a schematic diagram for illustrating the inventive electrophotographic apparatus where the photoconductive drum is separated from the transfer roller in the case no sheet of print media is found therebetween.
Figure 4:
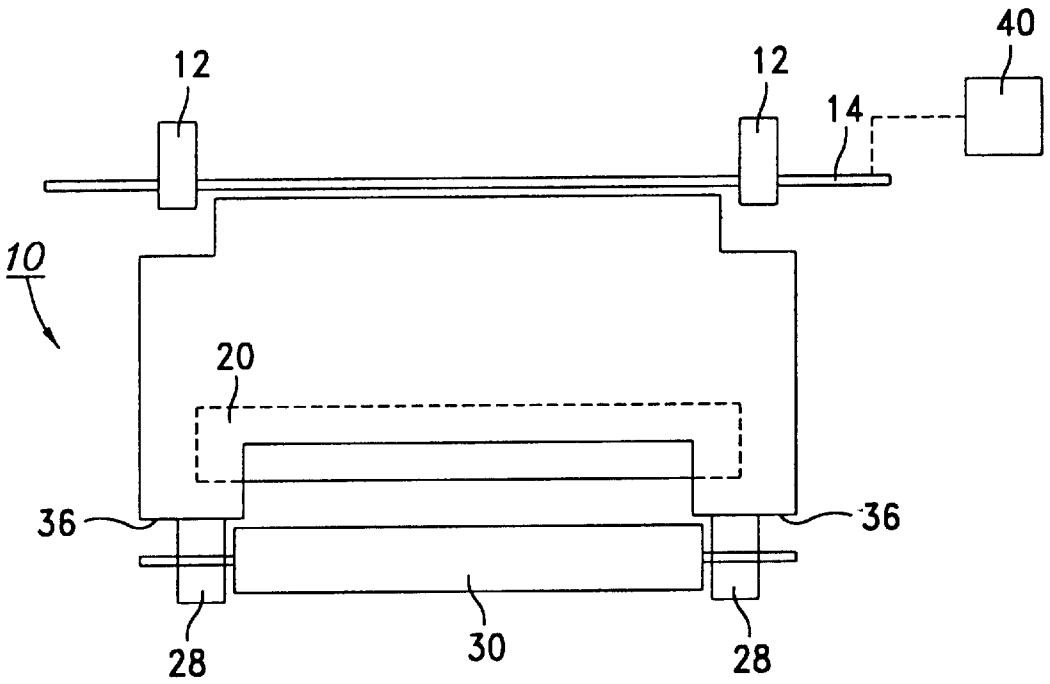
FIG. 4 is a front view of FIG. 3 looking in the direction of III—III'.

Referring to FIGS. 3 and 4, there is shown a developing unit 10 made up of a photoconductive drum 20 rotated at a given speed, a charging roller 18 mounted on one side of the photoconductive drum 20 to charge its surface to form a uniform electric charge layer and a developing roller 22 mounted on another side of the photoconductive drum 20 to develop a latent image formed on its surface with a toner. An exposing unit 16 is also mounted to form a latent image on the surface of the photoconductive drum 20 electrostatically charged.

A pair of cams 12 are respectively mounted on both sides of the developing unit 10 to shift the developing unit 10 so that the photosensitive drum 20 contacts an image transfer roller 30 when a sheet of paper is conveyed between them. The cams 12 are mounted on a cam shaft 14 to transmit the rotational force of a drive motor 40. The transfer roller 30 is mounted below the developing unit 10 to transfer a toner image formed on the photoconductive drum 20 to a sheet of paper 38. The main frame 24 is provided with a pressure spring 32 to push the transfer roller 30 towards the photoconductive drum 20. One end of the pressure spring 32 is connected with a voltage source. A pair of resilient parts 28 formed of plate springs are respectively mounted on both sides of the main frame 24 to push the bottom 36 of the developing unit 10 so as to separate the photoconductive drum 20 from the transfer roller when there is no sheet of paper 38 between them.

On one side of the main frame 24 is also mounted a first sensor 26 to detect a sheet of paper 38 fed into the developing unit 10 to generate signals to apply a preset voltage to the transfer roller 30 and drive the drive motor 40. A second sensor 34 is provided before the discharging side of the developing unit 10 to detect jamming or discharging of the sheet 38 so as to generate signals to drive the drive motor to separate the photoconductive drum 20 from the transfer roller 30.

Figure 5:
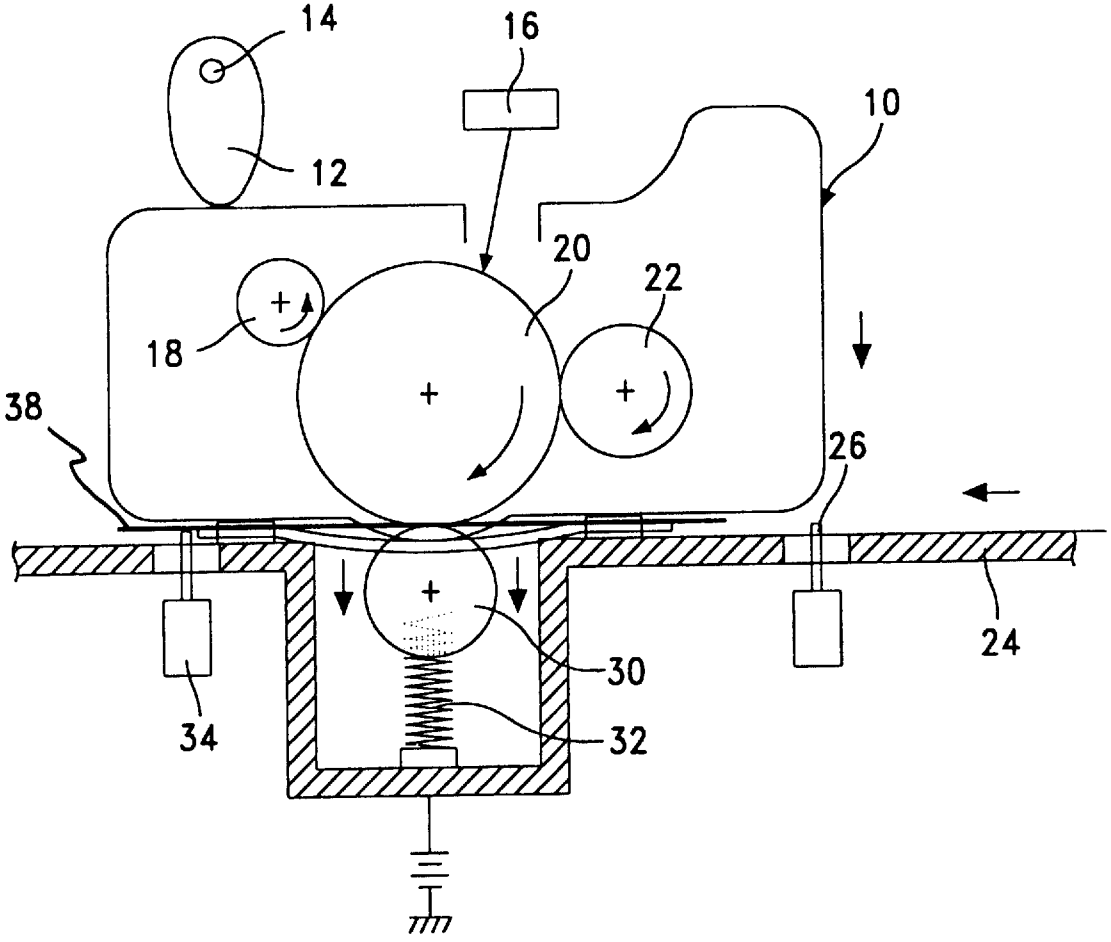
FIG. 5 is a schematic diagram for illustrating the inventive electrophotographic apparatus where the photoconductive drum is in contact the transfer roller as in the case when a sheet of print media is found therebetween.

In operation, the first sensor 26 senses a sheet of paper 38 conveyed by the rotation of the conveyor rolls 50 (FIG. 1) to generate the signals to apply the preset voltage to the transfer roller 30 and drive the motor 40 to rotate the cams 12, which shifts the developing unit 10 downwards so as to contact the photoconductive drum 20 with the transfer roller 30 under the pressure of the pressure spring 32 while a sheet of paper 38 is fed between them as shown in FIG. 5. Thus, a toner image formed on the photoconductive drum 20 is transferred by the pressure of the transfer roller 30 to the sheet 38, the discharging of which is sensed by the second sensor 34 to turn off the drive motor 40 to stop the cams 12. Then the developing unit 10 is shifted upwards to separate the photoconductive drum 20 from the transfer roller 30 as shown in FIG. 3 while the transfer roller is cut off the preset voltage. The subsequent steps are as described with reference to FIG. 1.

Meanwhile, if the second sensor 34 does not sense the discharging of the sheet 38 within a predetermined time after the sheet has been jammed before entering between the photoconductive drum 20 and the transfer roller 30, the drive motor 40 is cut off to move back the cams 12 to the initial position, thus separating them as shown in FIG. 3. Removing the jammed sheet 38, a printing signal is applied again to perform the printing process.

As described above, the inventive developing unit shifter consisting of a pair of cams and a pair of resilient parts shifts the developing unit downwards or upwards so as to contact or separate the photoconductive drum with or from the transfer roller according as a sheet of paper is placed between them or not, and therefore, the residual toner on the photoconductive drum does not stain the surface of the transfer roller, improving the transfer efficiency. In addition, the electrical resistance between the photoconductive drum and transfer roller is kept constant. Further, the photoconductive drum and transfer roller are prevented from being stained by foreign matter, and thus such foreign matter can be prevented from adhering to the back side of the sheet.

Although the present invention has been described in connection with the preferred embodiments, it will be apparent to those skilled in this art that various modifications may be made to them without departing the scope of the appended claims.

What is claimed is:

1. An electrophotographic apparatus, comprising:

a toner image transfer roller;

a developing unit, said developing unit being comprised of a photoconductive drum for rotation at a given speed, a charging roller for charging a surface of said photoconductive drum to form a uniform electric charge layer and a developing roller for developing a latent image formed on the surface of said photoconductive drum with a toner; and a developing unit shifter for shifting said developing unit upwards and downwards so as to make said photoconductive drum contact with and separate from said toner image transfer roller depending on whether a sheet of paper is supplied between said photoconductive drum and said toner image transfer roller.

2. The electrophotographic apparatus as defined in claim 1, wherein said developing unit shifter further comprises a pair of cams for pushing said developing unit to make said photoconductive drum contact said toner image transfer roller.

3. The electrophotographic apparatus as defined in claim 2, further comprising a pair of resilient parts for biasing said photoconductive drum away from said toner image transfer roller, said pair of resilient parts being plate springs of a given resilient force.

4. The electrophotographic apparatus as defined in claim 3, wherein said pair of cams are rotated in a given direction by means of a cam drive motor.

5. The electrophotographic apparatus as defined in claim 4, further comprising a sensor for sensing a paper jam and for generating a signal to drive said cam drive motor so as to separate said photoconductive drum from said toner image transfer roller.

6. An electrophotographic development apparatus, comprising:

a developing means having a photosensitive drum, said developing means having a first side and a second side opposite said first side;

a transfer roller disposed on said first side of said developing means;

a camming means, located on said second side of said developing means, for shifting said developing means and said photosensitive drum towards and away from said transfer roller.

7. The electrophotographic development apparatus of claim 6, further comprising a pair of resilient parts disposed on said first side of said developing means, said pair of resilient parts for biasing said photosensitive drum away from said transfer roller, said pair of resilient parts being plate springs of a given resilient force.

8. The electrophotographic development apparatus of claim 7, further comprising a first sensor and a second sensor, said first sensor for detecting when a sheet of print media is approaching said photosensitive drum and said transfer roller and said second sensor for detecting whether said sheet of print media is moving away from said photosensitive drum and said transfer roller.

9. The electrophotographic development apparatus of claim 8, wherein said camming means causes said developing means and said photosensitive drum to move towards said transfer roller and move to against a bias of said pair of resilient parts when said first sensor senses the passing of said sheet of print media.

10. The electrophotographic development apparatus of claim 9, wherein said camming means rotates to allow said pair of resilient parts to move said developing means containing said photosensitive drum away from said transfer roller when said second sensor senses the passing of said sheet of print media.

* * * * *